US006493533B1

(12) United States Patent
Munakata

(10) Patent No.: US 6,493,533 B1
(45) Date of Patent: Dec. 10, 2002

(54) IMAGE FORMING APPARATUS HAVING A BELT MEMBER AND A DRIVING ROLLER FOR THE BELT MEMBER

(75) Inventor: Atsushi Munakata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/430,030

(22) Filed: Oct. 29, 1999

(30) Foreign Application Priority Data

Oct. 30, 1998 (JP) ..... 10-325897

(51) Int. Cl.[7] ..... G03G 15/01; G03G 15/16

(52) U.S. Cl. ..... 399/301; 399/66; 399/303; 399/302

(58) Field of Search ..... 399/299, 303, 399/66, 301, 302

(56) References Cited

U.S. PATENT DOCUMENTS 4,916,547 A * 4/1990 Katsumata et al.
5,648,809 A * 7/1997 Kato et al.
5,666,599 A * 9/1997 Miyasaka et al. ..... 399/302 X
5,740,492 A * 4/1998 Deki et al. ..... 399/66
5,742,887 A * 4/1998 Suzuki et al. ..... 399/301
5,778,291 A * 7/1998 Okubo et al. ..... 399/302
5,923,936 A * 7/1999 Tanoue et al. ..... 399/302 X
5,995,802 A * 11/1999 Mori et al. ..... 399/301 X
6,038,423 A 3/2000 Tagawa et al. ..... 399/301
6,078,773 A * 6/2000 Shimojo et al. ..... 399/302

FOREIGN PATENT DOCUMENTS

JP 63-1148 * 1/1988
JP 7-43970 * 2/1995
JP 9-127847 * 5/1997

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes a belt member, a driving roller arranged to support the belt member and to transmit a driving force to the belt member, a plurality of image forming units arranged to respectively form a plurality of color images on the belt member or on a recording material borne by the belt member in such a way as to have the plurality of color images superposed on top of one another, a measuring sensor for measuring a length of time required for the belt member to move a predetermined distance, and a control circuit for controlling, on the basis of the length of time measured by the measuring sensor, the timing of start of forming each of the plurality of color images by each of the plurality of image forming units on the belt member or on the recording material borne by the belt member.

44 Claims, 7 Drawing Sheets

IMAGE FORMING APPARATUS HAVING A BELT MEMBER AND A DRIVING ROLLER FOR THE BELT MEMBER

BACKGROUND OF THE INVENTION

1. Field of the Invention

The present invention relates to an image forming apparatus capable of forming a full-color image by using the electrophotographic system, such as a copying machine, a printer, a facsimile apparatus, etc.

2. Description of Related Art

Among image forming apparatuses for forming images by electrophotographic processes, some of them are practicably arranged to be capable of forming images in full color. In order to form a full-color image at a high speed, it has been known to adopt a so-called tandem-type arrangement whereby a plurality of image forming parts (image forming units) are arranged in the direction of transporting a recording material.

In forming color images, causes of deteriorating image quality include positional discrepancy of component color images (hereinafter referred to as the color position discrepancy). The color position discrepancy takes place in cases where the positions of various component color images which constitute a full-color image deviate from each other in the direction of auxiliary scanning or main scanning or where they fail to be in parallel with each other.

In the case of the above-stated tandem-type image forming arrangement, images in different colors are formed at the respective different places. The tandem-type image forming apparatus is, therefore, more prone to the color position discrepancy than the conventional apparatus having only one image forming part (one photosensitive drum).

The color position discrepancy takes place in varied directions. The color position discrepancy taking place in the direction of auxiliary scanning results from static causes and dynamic causes. The static causes include deviation mainly caused by errors in respect of assembly or machining precision of parts, such as deviation from a correct distance between one image forming unit and another image forming unit, i.e., a difference in distance between photosensitive drums or exposure positions, and the precision of diameter or the like of a driving roller arranged to drive a belt-shaped recording-material bearing member which transports or conveys a recording material at a controlled speed at the time of transfer (for example, a belt member such as a transfer belt). The dynamic causes include fluctuations of the rotating speed of the photosensitive drum or the transfer belt, etc.

The static causes are removable by a correction process, for example, by electrically adjusting exposure timing, a least at the time of shipping the apparatus from a manufacturing factory.

The dynamic causes are, on the other hand, difficult to eliminate by any correction process. The fluctuations of the rotating speed of the photosensitive drum and the fluctuations of the transport speed of the recording material by the transfer belt, however, must be minimized. To attain this purpose, therefore, efforts have been exerted in various manners to improve the precision of a drive source such as the above-stated driving roller, etc., and a method of control over the drive source.

For example, the apparatus is arranged to prevent any eccentricity of a driving roller from contributing to the color position discrepancy by arranging the distance between the image forming units to be integer times as much as the circumference of a driving pitch circle defined by the neutral plane of the transfer belt.

However, in a case where a belt member is used, the eccentricity of the driving roller is only one of causes for fluctuations of the speed. For example, to transmit a rotative driving force to the transfer belt without any slip, the driving roller is provided with a rubber layer on its surface. Therefore, the use of the driving roller over a long period of time causes some wear of its surface or some peripheral wear of the belt, which causes some change in radius from the center of the driving roller to the neutral plane of the belt, and thus eventually causes a change in linear speed of the belt.

Even a slight degree of such a wear brings about the color position discrepancy. For example, with the diameter of the belt driving roller assumed to be D (mm), the thickness of the belt to be T (mm) and an image forming speed to be V (mm), the diameter of the neutral plane of the belt (the diameter of the pitch circle) is "D+T" (mm). With N assumed to be an integer, the distance between the image forming units is represented as "N×π×(D+T)". In a case where the apparatus is made in the smallest size, therefore, the distance between the image forming units becomes "π×(D+T)" (mm).

Assuming that the amount of decrease in thickness of the belt is expressed as ΔT and the amount of decrease in diameter of the driving roller as ΔD, the amount of change of the image forming speed can be expressed as follows:

$$(\Delta T+\Delta D)/(T+D)\times V(\text{mm/sec}) \quad (1)$$

Generally, a full-color image is formed by using four image forming units. Therefore, a distance between the furthest-parted image forming units is "3×π×(T+D)" (mm). A period of time necessary for passing these image forming units at a normal image forming sped then can be expressed as follows:

$$3\times\pi\times(T+D)/V(\text{sec}) \quad (2)$$

Therefore, the amount of position discrepancy between component color images taking place between the furthest-parted image forming units can be obtained by multiplying the formulas (1) and (2) by each other as follows:

$$3\times\pi\times(\Delta T+\Delta D) \quad (3)$$

In other words, even in a case where the diameter of the roller is worn and decreased by only 5 μm and the thickness of the belt also by only 5 μm, for example, the amount of color position discrepancy reaches about 94 μm, as found from the formula (3), so that the color position discrepancy which exceeds two pixels in the case of resolution of 600 dpi would occur.

Various methods have been developed against such a color position discrepancy due to the wear of parts or due to other disturbances or causes. Known prior art methods for this purpose include the following: (i) Means for reading an image recorded on the belt member is provided, and exposure timing or an exposure position is controlled on the basis of the result of reading. (ii) The moving speed of the belt member is detected, as desired, from a pattern formed on the belt member, and the speed of the belt member during an image forming process, exposure timing or an exposure position is controlled, as necessary, on the basis of the result of detection.

However, according to the method (i), the image forming apparatus must be arranged to include means for reading the formed image and the mechanism for correcting the exposure positions. This method inevitably causes an increases in cost, necessitates complex arrangement and an increase in size of the apparatus.

The method (11) necessitates a high-resolution encoder to be arranged on the belt member and requires control over the transport speed of the belt member and the exposure positions during the image forming process. This method, therefore, has the same shortcomings as those of the method (i).

BRIEF SUMMARY OF THE INVENTION

It is an object of the invention to provide an image forming apparatus simply arranged, without recourse to any complex arrangement, to be capable of forming an image without any color position discrepancy despite of occurrence of changes caused by aging in the thickness of a belt member and in the diameter of a driving roller which is arranged to drive the belt member.

The above and other objects and features of the invention will become apparent from the following detailed description of preferred embodiments thereof taken in conjunction with the accompanying drawings.

DETAILED DESCRIPTION OF THE INVENTION

Hereinafter, preferred embodiments of the invention will be described in detail with reference to the drawings.

Figure 1:
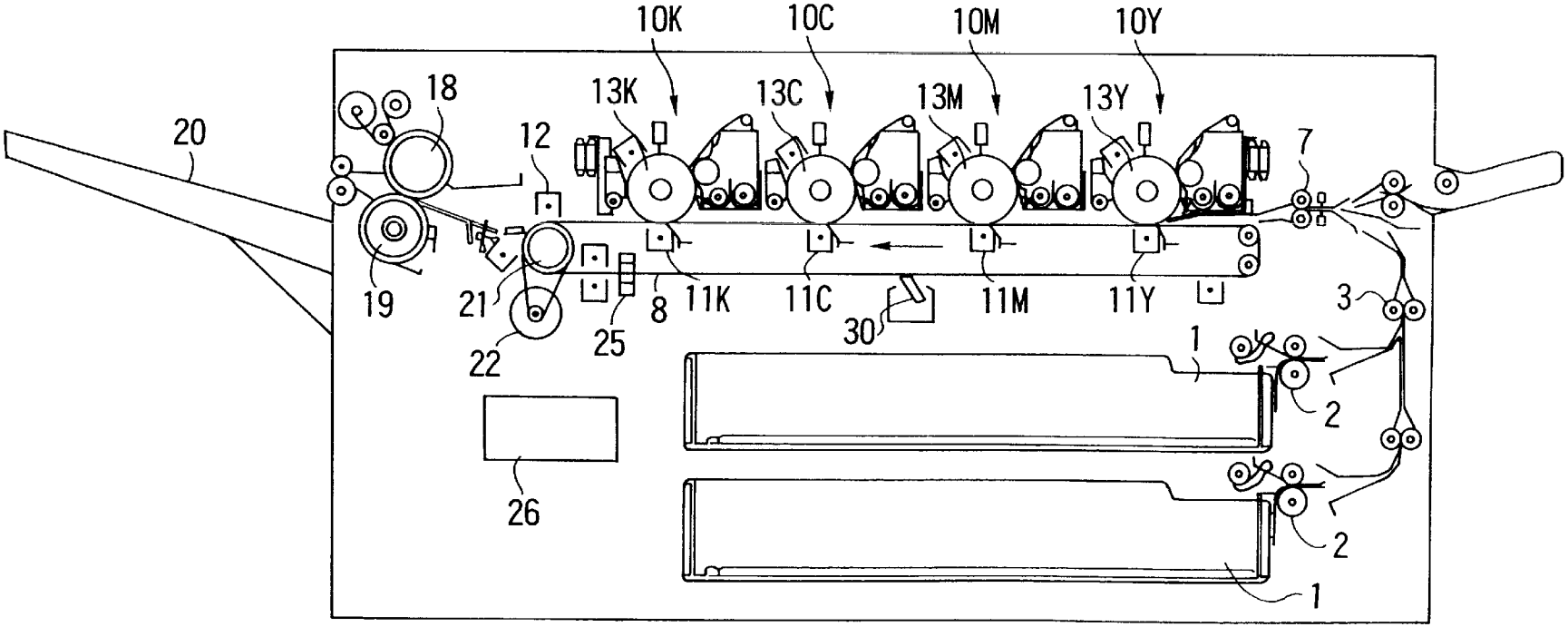
FIG. 1 is a sectional view showing the arrangement of an image forming apparatus according to a first embodiment of the invention.

FIG. 1 shows an electrophotographic image forming apparatus according to a first embodiment of the invention. The image forming apparatus is a tandem-type color copying machine which is arranged to form a full-color image by superposing on one another four color toners of yellow, magenta, cyan and black.

In FIG. 1, reference numeral 8 denotes a recording-material bearing member serving as a belt member, i.e., a transfer belt. Image forming units (image forming parts) 10Y, 10M, 10C and 10K are arranged above the transfer belt 8 and along the transporting direction of the transfer belt 8 to serve as image forming means for yellow, magenta, cyan and black images, respectively. The image forming units 10Y, 10M, 10C and 10K respectively have photosensitive drums 13Y, 13M, 13C and 13K arranged on the upper side of the transfer belt 8.

After a recording paper, serving as a recording material, contained in a cassette 1 is fed by a paper feed roller 2, the recording paper is transported to a registration roller 7 by a transport roller 3. The registration roller 7 sends out the recording paper to the transfer belt 8 by correcting any oblique movement or the like of the recording paper and at correct timing. The transfer belt 8 is made of an insulating resin sheet material and is arranged to be driven by a pulse motor 22 through a driving roller 21. Transfer chargers 11Y, 11M, 11C ad 11K are arranged to charge with electricity the transfer belt 8 from on its lower side.

In the meantime, by image information signals sent from an original reading device (not shown) or an output device (not shown) such as a computer, electrostatic latent images which correspond respectively to the four different colors are formed on the surfaces of the photosensitive drums 13Y, 13M, 13C and 13K. The recording paper sent out from the registration roller 7 is statically attracted onto the transfer belt 8 which is charged. The recording paper is then conveyed by the transfer belt 8 passing through the lower sides of the image forming units 10Y, 10M, 10C and 10K one after another in this state without coming off or slipping while it is being conveyed.

Figure 2:
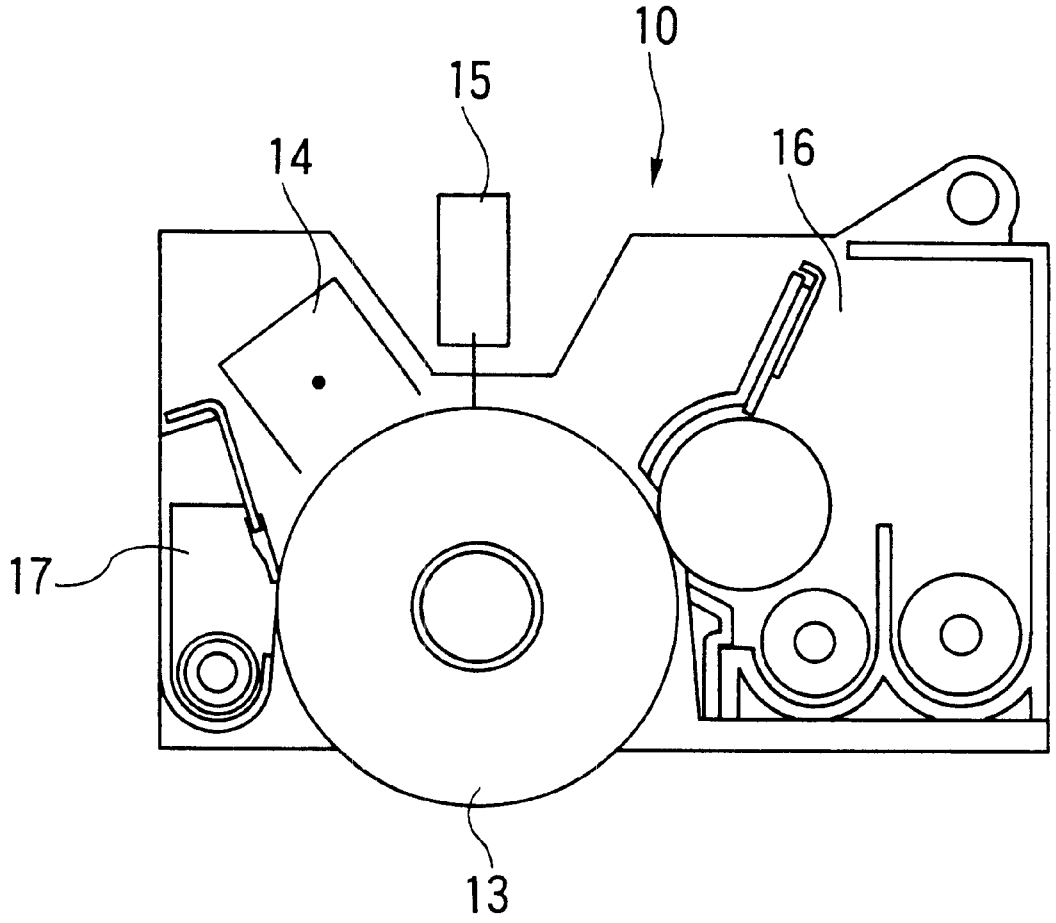
FIG. 2 is a sectional view showing the arrangement of each of image forming units of the image forming apparatus shown in FIG. 1.

As shown in FIG. 2, the image forming units 10 (10Y, 10M, 10C and 10K) are detachably mounted on the body of the apparatus as process cartridges. Each of the image forming units 10 has a primary charger 14, a developing device 16 and a cleaner 17 arranged around the photosensitive drum 13 (13Y, 13M, 13C or 13K). The surface of the photosensitive drum 13 is charged through an exposure made by the primary charger 14. An exposure made through each LED array 15 which is secured to the body of the image forming unit as exposure means to form a latent image. The latent image is developed by the developing device 16. A toner image of each color is thus formed on the surface of the photosensitive drum 13 by an electrophotographic process.

The toner image of each color formed on the photosensitive drum 13 is transferred to the surface of the recording paper which is conveyed in the state of being attracted to the transfer belt 8 to a transfer part. The toner images of colors are thus transferred to the surface of the recording paper to be superposed on top of one another by each of the transfer chargers 11 (11Y, 11M, 11C and 11K).

With the toner images of the four colors of yellow, magenta, cyan and black thus transferred to the recording paper, the recording paper is peeled off from the transfer belt 8 by a separation charger 12. The peeled recording paper then reaches a pair of fixing rollers 18 and 19. The fixing roller 18, which is one of the pair, is in a state of having been heated by a heater (not shown). The toners of different colors are fixed to the recording paper by thermal fusion caused by the heating and pressing actions of the pair of fixing rollers 18 and 19 to give a full-color image. The recording paper to which the toner images are fixed is delivered onto a paper delivery tray 20, which projects outward from the apparatus. Unnecessary matters such as the toners adhering to the surface of the transfer belt 8 are scraped off by a cleaning blade 30 and are recovered.

Figure 3:
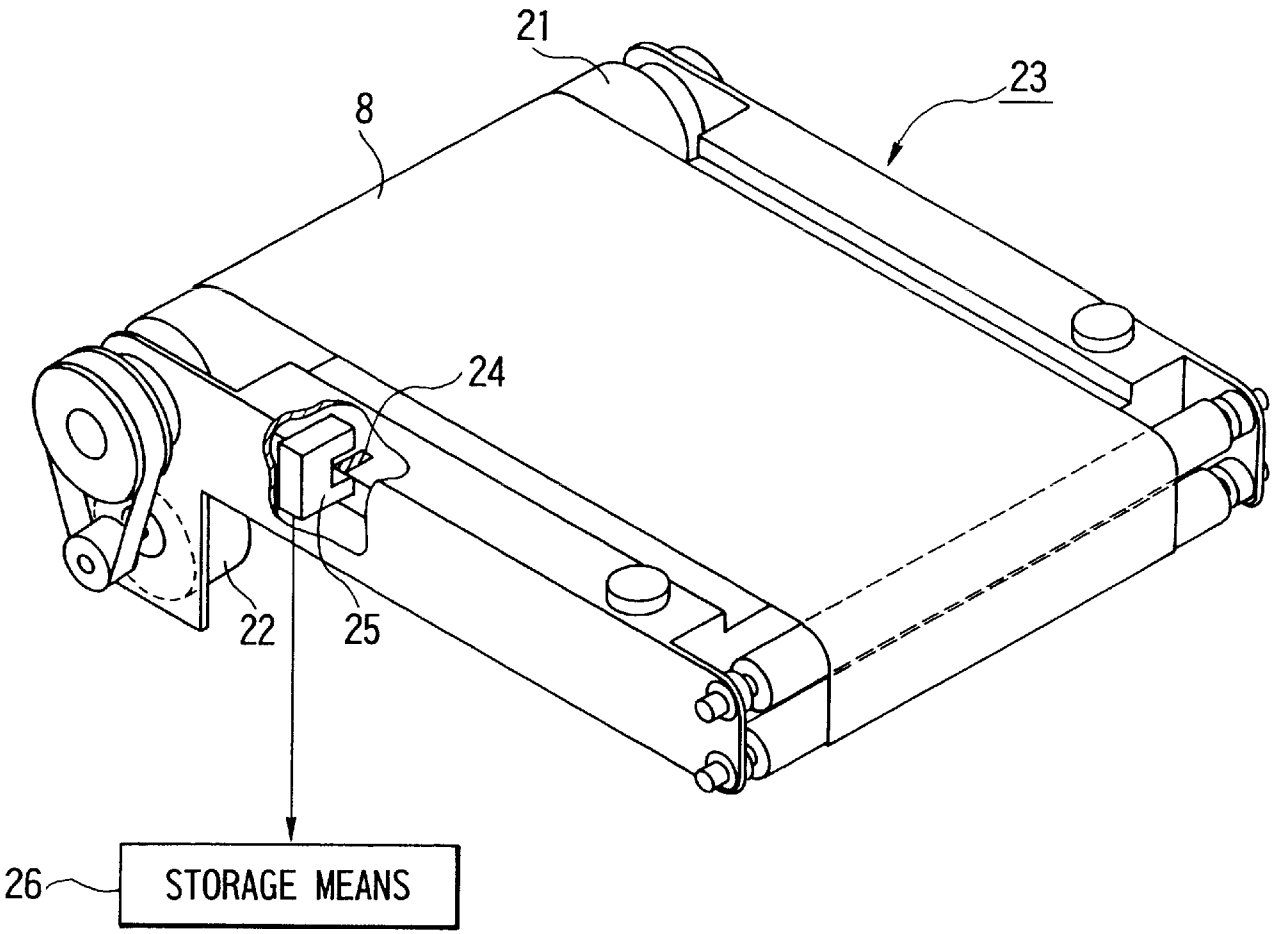
FIG. 3 is a perspective view showing a transfer unit of the image forming apparatus shown in FIG. 1.

As shown in FIG. 3, the transfer belt 8 is made to constitute a transfer unit 23 jointly with the driving roller 21, etc.

In the first embodiment, the driving roller 21 measures 29.9 mm in diameter, while the transfer belt 8 measures 0.1 mm in thickness. Therefore, the diameter of the pitch circle of the transfer belt 8 is 30 mm. To avoid an adverse effect of eccentricity of the driving roller 21 which is driven by the motor 22, as mentioned in the foregoing, the image forming units 10 are arranged at a spacing distance of "30×π" mm which is equal to the circumference of the driving pitch circle of the transfer belt 8.

The design value of the image forming speed, i.e., the transport speed of the transfer belt 8, is 100 mm/sec, and the one-revolution (round) length of the transfer belt 8 is 1000 mm.

According to the invention, as shown in FIG. 3, a mark 24 is printed on the inner side of the transfer belt 8 at an arbitrary position of the edge part thereof extending in the direction of transport. Detecting means 25 is provided within the transfer unit 23 for detecting the passing of the mark 24, i.e., the passing of a predetermined point of the transfer belt 8. Since the transfer belt 8 is semitransparent in the case of the first embodiment, a light-transmitting type photo-interrupter is arranged, as the detecting means 25 for detecting the passage of the mark 24, on the lower side track of the transfer belt 8 in such a way as to have the edge part of the transfer belt 8 sandwiched in between the parts of the photo-interrupter.

The passing intervals of the mark 24 are measured in the following manner. The transfer belt 8 is driven by the driving roller 21 in a state of not forming any image. A period of time elapsing after detection of the first passing of the mark 24 until the passing of the mark 24 is next detected, i.e., a passing interval time of the mark 24 corresponding to the transport sped of the transfer belt 8, is measured with a counter. This time measuring action is continuously performed while the transfer belt 8 makes eleven revolution rounds to obtain time data for a total of ten times on the passing interval of the mark 24. The ten time values thus obtained are averaged. The average value of the time data is stored in storage means 26 as data of passing interval of the mark 24.

A period of time required for one round (of revolution) of the transfer belt 8 is thus measured as a minimum unit of measurement. Therefore, even in the event of occurrence of eccentricity in the driving roller 21, the time required for one round of the transfer belt 8 can be accurately found.

According to the invention, the above-stated passing interval time of the mark 24 of the transfer belt 8 is first measured in a shipping state at the time of adjustment before the image forming apparatus is shipped from the factory. The data of passing interval thus obtained is stored as an initial value in the storage means 26. Further, before shipment from the factory, the image forming apparatus is adjusted in such a way as to minimize the color position discrepancy which takes place in the direction of paper feeding due to errors in respect to the diameter of the driving roller 21, the thickness of the transfer belt 8, the positions of the image forming units, etc.

Since the apparatus is designed to have the transfer belt 8 measure 1000 mm in circumference and the belt transport speed at 100 mm/sec, the initial value of the passing interval data should be 10 sec. According to the results of tests, however, an actual measured value of this data (the average value of ten measured values) was 10225453 μsec (10.225453 sec) due to the errors of the diameter of the driving roller 21, the thickness of the transfer belt 8, etc.

Tests were conducted under the conditions of actual service at the user's place, after shipment from the factory, to measure the passing interval time of the mark 24 of the transfer belt 8 every time images were formed on 50,000 sheets in obtaining a total of "N×50,000" sheets (N: an integer). After the end of image forming on the first 50,000 sheets, the measured value (average of ten values) of passing interval of the mark 24 was 10226267 μsec (10.226267 sec). Compared with the value obtained at the time of shipment, the interval time became longer by 814 μsec. This increase resulted from the wear of the driving roller 21 and the transfer belt 8. By the wear, the effective driving radius (radius of pitch circle) of the transfer belt 8 obtained by the driving roller 21 was decreased to lower the transport speed of the transfer belt 8.

Therefore, an arrangement for having the four image forming units 10Y to 10K form toner images at the same timing as the initial timing and for having each toner image transferred onto the recording paper transported by the transfer belt 8 causes a color image thus obtained to have color position discrepancy among the toner images of the different component colors. To solve this problem, according to the invention, the color position discrepancy is eliminated by correcting and adjusting the image forming timing, i.e., image exposure timing, of each image forming unit on the basis of the delay of passing interval time of the mark 24.

In the case of the first embodiment of the invention, the image forming apparatus is beforehand provided with a correction program including processes from the process of measuring the passing interval time of the mark 24 up to the process of correcting the exposure timing. The correction process is thus arranged to be automatically carried out according to the program.

Figure 4:
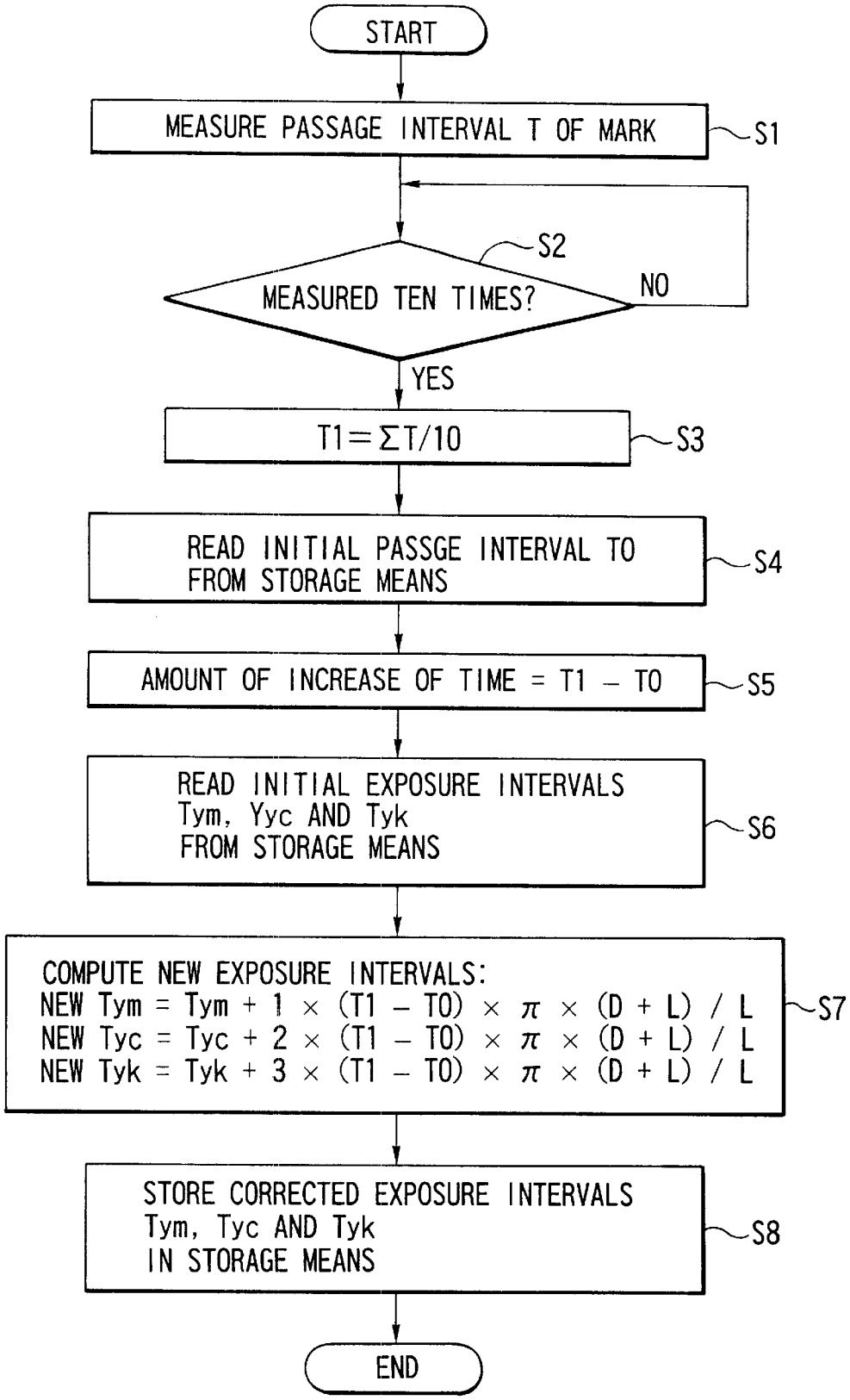
FIG. 4 is a flow chart showing a correction process to be executed in the first embodiment.

FIG. 4 is a flow chart showing the above-stated correction process. Referring to FIG. 4, at a step S1 after the start of the flow of operation with a measuring mode selected, the transfer belt 8 is driven by the driving roller 21 in a state of not forming any image. When the first passing of the mark 24 is detected by the detecting means 25, the counter is operated to measure the passing interval time T until the next passing of the mark 24 is detected. This action is continuously performed while the transfer belt 8 makes 11 rounds of revolution to obtain a total of ten measured values of the time data T of the passing interval of the mark 24. At a step S2, a check is made for the tenth value of the measured time data T.

At a step S3, the ten values of the passing interval time data T are averaged to obtain a mean value as measured passing interval time data T1. At a step S4, data T0 (an initial value) of the passing interval of the mark 24 which is obtained at the time of shipment from the factory and stored in the storage means 26 is read out from the storage means 26. At a step S5, the measured passing interval time data T1 is compared with the initial mark passing interval time data T0 to compute the amount of increase of passing interval time. The amount of increase of passing interval time is expressed as "T1−T0" (sec).

As mentioned above, the mark passing interval time T1 measured at the end of image forming on the first 50,000 sheets is 10226267 μsec, which shows that the value of the interval time data for the mark 24 obtained at the time of shipment from the factory has become longer by 814 μsec.

The exposure start timing of each image forming unit 10 is corrected on the basis of the above-state result of comparison. When the transport speed of the transfer belt 8 lowers, the color position discrepancy can be corrected by causing the image forming start time points of the image forming units 10M, 10C and 10K, which are allocated on the downstream side of the leading image forming unit 10Y, to delay on after another with respect to that of the leading image forming unit 10Y.

Assuming that, in the initial state obtained at the time of shipment from the factory, the exposure interval between the leading image forming unit 10Y and the second image forming unit 10M is expressed as Tym, the exposure interval between the leading image forming unit 10Y and the third image forming unit 10C as Tyc and the exposure interval between the leading image forming unit 10Y and the fourth image forming unit 10K as Tyk, the data of these initial exposure intervals Tym, Tyc and Tyk are stored in the storage means 26. At a step S6, therefore, the data of these initial exposure intervals are read out from the storage means 26. At a step S7, new values of these exposure intervals Tym, Tyc and Tyk are computed. At the next step S8, the computed new data of the exposure intervals are stored in the storage means 26 and are set as exposure intervals to be used after the correction.

The new exposure intervals are computed and obtained from the diameter D of the driving roller 21, the thickness T of the transfer belt 8, the circumference L of the transfer belt 8 (all of them are central values of design) and the spacing interval "π×(D+T)" between the image forming units 10, as follows:

$$\text{new } Tym = Tym + 1\times(T1 - T0)\times\pi\times(D+T)/L$$

$$\text{new } Tyc = Tyc + 2\times(T1 - T0)\times\pi\times(D+T)/L$$

$$\text{new } Tyk = Tyk + 3\times(T1 - T0)\times\pi\times(D+T)/L$$

In other words, according to the passing time interval of the mark 24 currently measured, the exposure start time points of the image forming units 10M, 10C and 10K, after that of the leading image forming unit 10Y, are delayed from their previous start points respectively by 77 μsec, 153 μsec and 230 μsec.

The results of tests indicate that, by virtue of the operation described above, the state in which the transport speed of the transfer belt 8 initially obtained at the time of shipment has become lower by "(T1−T0)/T0×100=0.008%" after the end of image forming on 50,000 sheets of paper can be brought back to the initial state of having almost no color position discrepancy.

Immediately before the above-stated correction process, a color position discrepancy of "3×π×(D+T)×0.008/100"= 0.023 mm, i.e., about 23 μm, is caused by a decrease of only 0.008% in the transport speed of the transfer belt 8 between the image forming units 10Y and 10K. If the correction process is not executed and the driving roller 21 and the transfer belt 8 further wear away at the same rate, a color position discrepancy of nearly 90 μm would take place when images are formed on 200,000 sheets of recording paper (this color position discrepancy corresponds to two pixels in the case of resolution of 600 dpi).

The first embodiment described above is arranged by way of example to decide the time of carrying out the correction according to the number of sheets of recording paper on which images are formed. However, the invention is not limited to this timing of correction timing. The correction timing may be changed to be decided, for example, according to the lapse of a predetermined period of time, such as a number of days, or to be decided by the operator of the apparatus as desired. Further, the correction may be arranged either to be automatically carried out or to be carried out by the operator.

Figure 5:
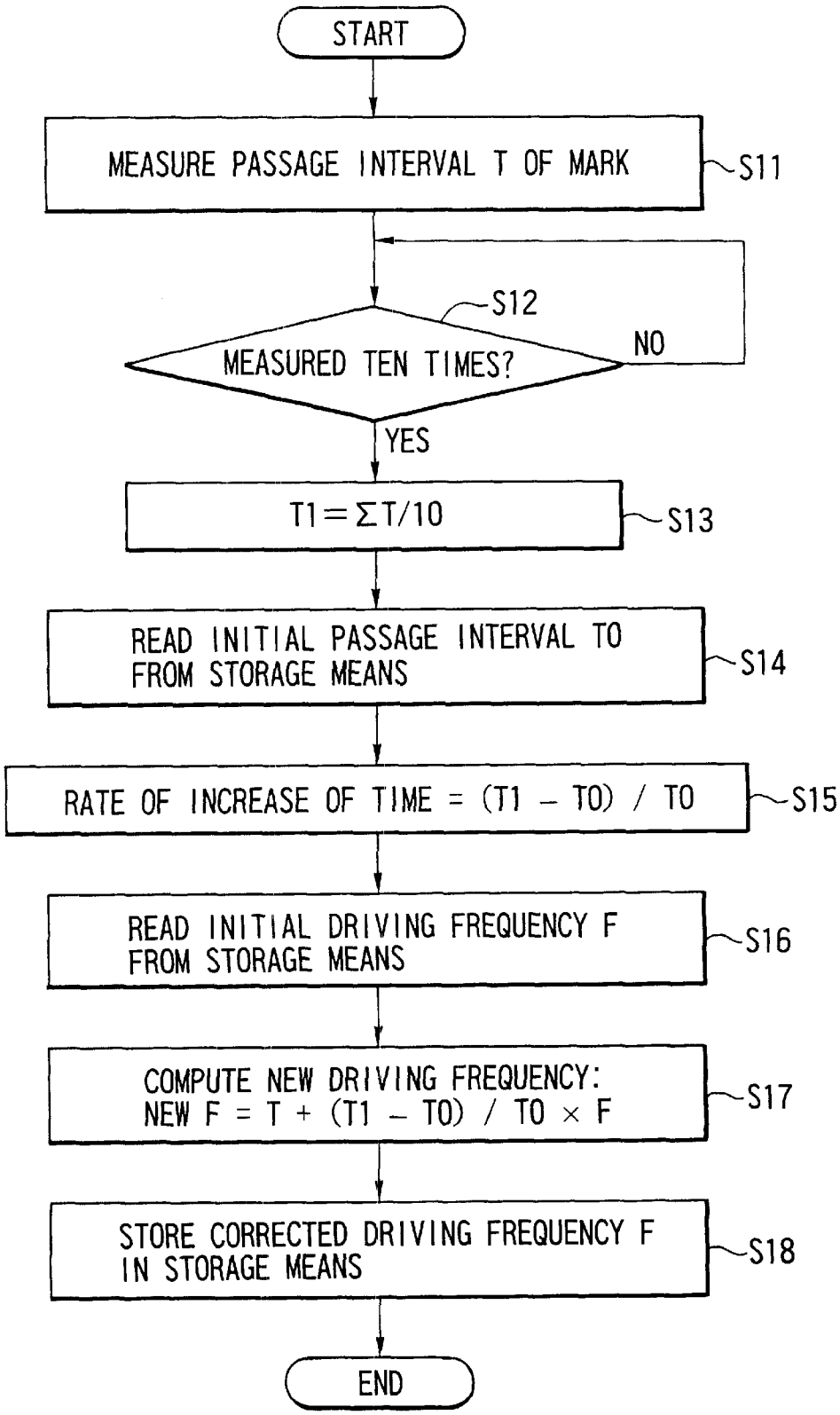
FIG. 5 is a flow chart showing a correction process to be executed in a second embodiment of the invention.

FIG. 5 is a flow chart showing a correction process to be executed in a second embodiment of the invention. An image forming apparatus according to the second embodiment is arranged basically in the same manner as the arrangement of the first embodiment. Therefore, the structural arrangement of the second embodiment is omitted from the following description.

In the first embodiment, the passing of the mark 24 of the transfer belt 8 is detected by the detecting means 25 to measure the passing interval time of the mark 24. Then, on the basis of the measured passing interval time, the exposure start timing of each image forming unit 10 is corrected in such a way as to lower the amount of color position discrepancy caused by the wear of the driving roller 21 and that of the transfer belt 8.

In the case of the second embodiment, with the passing interval time of the mark 24 of the transfer belt 8 measured, the transport speed of the transfer belt 8 is further computed from the measured passing interval time. Then, the transport speed of the transfer belt 8 is corrected to its initial value by changing and adjusting the rotation angular velocity of the driving roller 21, i.e., by changing the rotation speed of the driving roller 21, in such a way as to lower the amount of color position discrepancy caused by the wear of the driving roller 21 and that of the transfer belt 8.

In the second embodiment, like in the case of the first embodiment, the driving roller 21 of the transfer unit 23 shown in FIG. 3 measures 29.9 mm in diameter, the transfer belt 8 measures 0.1 mm in thickness, and the diameter of the pitch circle of the transfer belt 8 is 30 mm. To eliminate the adverse effect of eccentricity of the driving roller 21, the image forming units 10 are allocated and spaced at a distance of "30×π" mm which is equal to the circumference of the pitch circle of the transfer belt 8. The image forming speed, i.e., a designed transport speed of the transfer belt 8, is 100 mm/sec, and the one-round (one-revolution) length of the transfer belt 8 is 1000 mm.

Like in the case of the first embodiment, the mark 24 is provided at one part of the edge on the inner side of the transfer belt 8 extending in the direction of transport. The passing of the mark 24 is arranged to be detected by the detecting means 25 which is disposed on the lower track of the transfer belt 8. The passing interval time of the mark 24 is measured at the time of shipping the image forming apparatus from the factory and also at the end of image forming on every 50,000 sheets of recording paper. In measuring, the passing interval time is measured ten times each time. The ten measured values thus obtained are averaged. The average value is used as passing interval data of each measuring time. The passing interval (time) data thus obtained is stored in the storage means 26 of the apparatus. The result of actual measurement of the passing interval time of the mark 24 obtained at the time of shipment from the factory (initial value) was 10225434 μsec.

Further, in shipping the image forming apparatus from the factory, the apparatus is adjusted in such a way as to minimize the color position discrepancy taking place in the direction of paper feeding due to errors in respect of the diameter of the driving roller 21, the thickness of the transfer belt 8, the positions of the image forming units, etc.

In the case of the second embodiment, a five-phase pulse motor of 2000 pulse/turn is employed as the motor 22 for the driving roller 21 shown in FIG. 3. The driving roller 21 is driven by the motor 22 at a reduction rate of ¼. Therefore, in order to obtain the designed image forming speed which is 100 mm/sec, the driving frequency of the motor 22 is set at 8488.26 Hz. This value is set as an initial value of driving frequency which corresponds to the initial value of the transport speed of the transfer belt 8. The initial value of driving frequency is stored in the storage means 26.

The correction process to be performed in the second embodiment is described below with reference to the flow chart of FIG. 5.

As steps S11 and S12 of FIG. 5, the time T of the passing interval of the mark 24 is continuously measured, in the same manner as in the case of the first embodiment, while the transfer belt 8 makes 11 rounds of revolution. At a step S13, a total of ten measured values of passing interval time of the mark 24 thus obtained are averaged to obtain measured data T1.

The value of data T1 of the mark passing interval measured at the end of image forming on the first 50,000 sheets is 10226267 μsec, which shows that the value of the interval data obtained at the time of shipment from the factory has become longer by 833 μsec. This indicates that the transport speed of the transfer belt 8 has decreased as a result of the decrease of the effective driving radius of the transfer belt 8 caused by the wear of the driving roller 21 and that of the transfer belt 8.

If this state is allowed to continue, the color image formed on the recording paper which is conveyed by the transfer belt 8 would come to show color position discrepancy. Therefore, the second embodiment is arranged to correct the transport speed of the transfer belt 8 to its initial speed by correcting and adjusting the angular velocity of the driving roller 21.

In order to transmit the rotative driving force to the transfer belt 8 without any slipping, a rubber layer is provided over the surface of the driving roller 21. Therefore, the rotation speed of the transfer belt 8 can be adequately corrected by correcting the rotating speed (angular velocity) of the driving roller 21.

At a step S14, the mark passing interval data T0 (initial value) which is obtained at the time of shipment from the factory and is in store at the storage means 26 is read out. At a step S15, the data T0 is compared with the measured data T1, and the rate of increase of the passing interval time is computed as "(T1−T0)/ T0" (%). At a step S16, the data of the current driving frequency F which is in store as an initial value is read out. At a step S17, a value ΔF (Hz) is computed by multiplying the current driving frequency F by the time increase rate "(T1−T0)/T0" obtained at the step S15. Then, the value ΔF is added to the current driving frequency F to obtain a new driving frequency F. This new driving frequency F can be expressed as follows:

$$\text{new } F=F+(T1-T0)/T0\times F$$

In other words, with the driving frequency F set at 8488.26 Hz at the time of shipment from the factory, the value ΔF becomes "(T1−T0)/T0×F"=0.69 Hz. Then, the new driving frequency F is increased by 0.69 Hz to become 8488.95 Hz (F=8488.26+0.69).

At a step S18, the new driving frequency F is set as a driving frequency after correction and is stored in the storage means 26. After this, the driving frequency of the pulse motor 22 of the driving roller 21 is increased by 0.69 Hz. This increases the rotating speed (angular velocity) of the driving roller 21. As a result, the transport speed of the transfer belt 8, which has been lowered by the wear of the diameter of the driving roller 21 and that of the transfer belt 8, is corrected to its initial value.

After the correction, the above-stated process is repeated every time the number of sheets of recording paper on which images have been formed reaches 50,000 sheets in the same manner as in the case of the first embodiment. The color position discrepancy due to the wear of the diameter of the driving roller 21 and that of the thickness of the transfer belt 8 can be kept below a certain level by the correction process described above.

While the second embodiment is arranged, by way of example, to drive the driving roller 21 by means of the pulse motor 22, the invention is not limited to the use of a pulse motor. For example, the invention applies also to a case where the speed of the driving roller is lowered by using a DC servo motor under PLL control. In other words, the control target value of the PLL control can be changed to arbitrarily set the angular velocity of the driving roller by changing a reference pulse frequency which is to be compared with an encoder pulse frequency.

Figure 6:
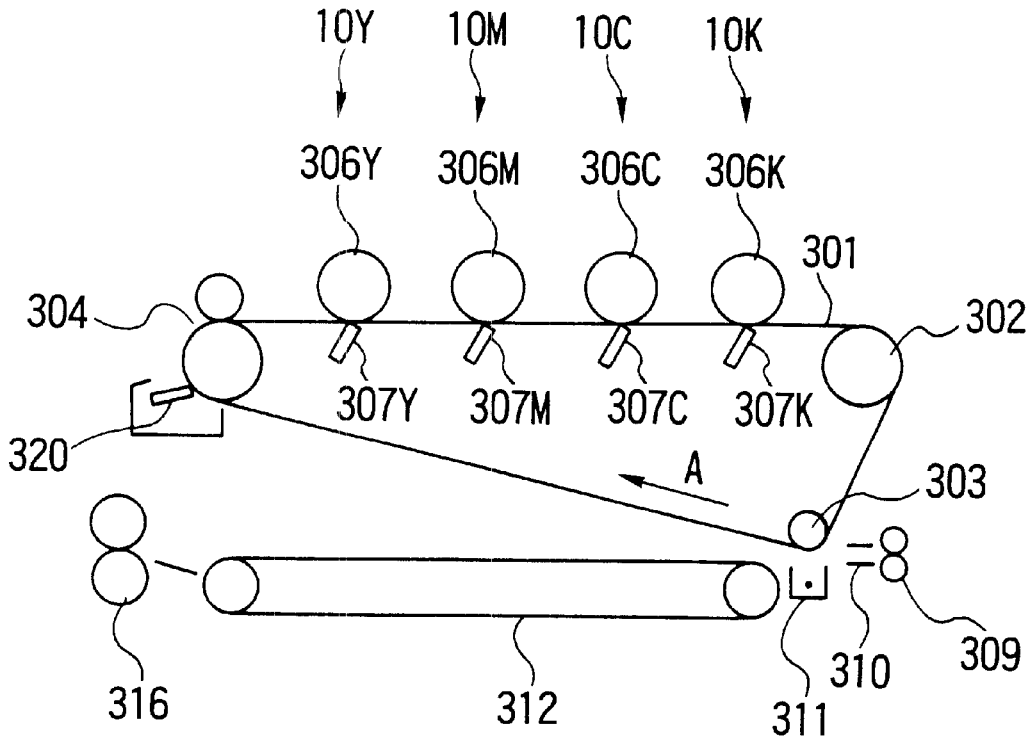
FIG. 6 is a sectional view showing the arrangement of an image forming apparatus according to a third embodiment of the invention.

FIG. 6 shows the arrangement of an image forming apparatus according to a third embodiment of the invention.

In the case of the third embodiment, the image forming apparatus is of an intermediate transfer type. An intermediate transfer belt 301 serving as a belt member is wrapped around a driven roller 302, a transfer roller 303 and a driving roller 304 and is arranged to revolve in the direction of arrow A. Image forming units 10Y, 10M, 10C and 10K of four colors are arranged side by side over the intermediate transfer belt 301 in the moving direction thereof. The image forming units 10Y, 10M, 10C and 10K are provided with photosensitive drums 306Y, 306M, 306C and 306K, respectively. Toner images of four colors formed by the image forming units 10Y, 10M, 10C and 10K are transferred onto the intermediate transfer belt 301 in a state of being superposed on each other. After that, the toner images of four colors are transferred together onto a recording material.

The image forming units 10Y to 10K are spaced at a distance which is set in relation to the thickness of the intermediate transfer belt 301 and the diameter of the driving roller 304 in the same manner as in the case of the first embodiment. Since the basic actions of the third embodiments are the same as those of the first embodiment, the details of the actions of the third embodiment are omitted from description. The image forming process of the third embodiment is as described below.

By image information signals sent from an original reading device (not shown) or an output device (not shown) such as a computer, electrostatic latent images which correspond respectively to the four different colors are formed on the surfaces of the photosensitive drums 306Y, 306M, 306C and 306K. The latent images are developed into toner images of the four colors by a developing device (not shown). The toner images are transferred serially onto the intermediate transfer belt 301 by transfer chargers 307Y, 307M, 307C and 307K in a state of being superposed on each other. As a result, a full-color image is formed on the intermediate transfer belt 301.

Meanwhile, in synchronism with the above-stated image forming process, the recording paper is sent out at predetermined timing, with its oblique movement corrected by a registration roller 309, to a transfer part of the intermediate transfer belt 301 where the transfer roller 303 is located. The toner images of four colors on the intermediate transfer belt 301 are then transferred all together onto the recording material (recording paper) by the transfer roller 303 located on the inner side and a charger 311 located on the outer side of the intermediate transfer belt 301.

The recording paper having the toner images of four colors transferred thereto is conveyed by a transport belt 312 to reach a pair of fixing rollers 316. One of the pair of fixing rollers 316 is heated by a heater (not shown). The toner of each color is then fixed to the recording paper by thermal fusion resulting from heating and pressing. As a result, a full-color image is completely formed on the recording paper. The recording paper having the toner images fixed thereto is delivered to the outside of the apparatus. Unnecessary matters such as toners adhering to the surface of the intermediate transfer belt 301, etc., are scraped off by a cleaning blade 320 and are recovered.

Since a full-color image is formed by superposing the toner images formed by the plurality of image forming units on each other on the intermediate transfer belt 301, some color position discrepancy takes place in the full-color image formed on the intermediate transfer belt 301, also in the case of the third embodiment, when the speed of the intermediate transfer belt 301 is caused to vary by changes taking place in thickness of the intermediate transfer belt 301 and in diameter of the driving roller 304 as a result of their wear.

To solve this problem, according to the third embodiment, too, a mark is formed on the intermediate transfer belt 301, and the passing intervals of the mark are measured by detecting the mark at a predetermined point of time. Then, a correction process is carried out according to the measured value of the mark passing interval in a manner similar to the correction processes of the first and second embodiments described in the foregoing. The color position discrepancy can be suppressed to a level not exceeding a predetermined value by the correction process like in the cases of the first and second embodiments.

Figure 7:
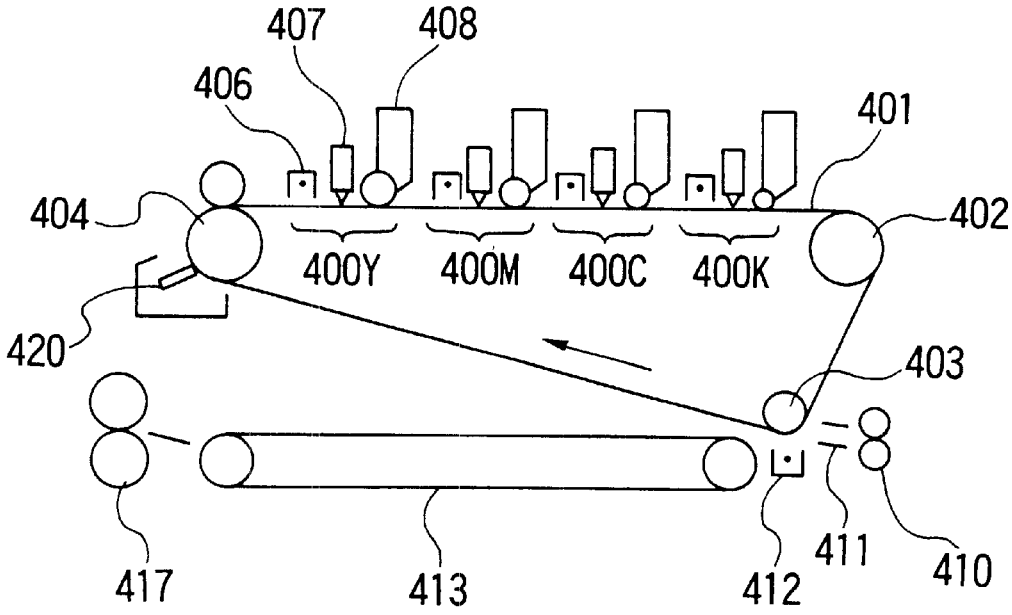
FIG. 7 is a sectional view showing the arrangement of an image forming apparatus according to a fourth embodiment of the invention.

FIG. 7 shows the arrangement of an image forming apparatus according to a fourth embodiment of the invention.

In the fourth embodiment, a photosensitive belt 401 (a belt member) is provided as an image bearing member. The photosensitive belt 401 is wrapped around a driven roller 402, a transfer roller 403 and a driving roller 404 and is arranged to revolve. Image forming units 400Y, 400M, 400C and 400K of four colors, i.e., yellow, magenta, cyan and black, are arranged side by side over the photosensitive belt 401 in the moving direction thereof. Each of the image forming units 400Y, 400M, 400C and 400K is provided with a primary charger 406, an image exposure device 407, a developing device 408, etc.

By image information signals sent from an original reading device (not shown) or an output device (not shown) such as a computer, electrostatic latent images corresponding to the four colors are formed on the photosensitive belt 401 respectively by the image forming units 400Y, 400M, 400C and 400K. The latent images thus formed are serially developed by the respective developing devices 408. As a result, a full-color image is formed on the photosensitive belt 401 by superposing toner images of the four colors on each other.

In synchronism with the above-stated image forming process, the recording paper is sent out at predetermined timing, with its oblique movement corrected by a registration roller 410, via a guide 411 to a transfer part of the photosensitive belt 401 where the transfer roller 403 is located. The toner images of four colors on the photosensitive belt 401 are then transferred all together onto the recording paper by the transfer roller 403 located on the inter side and a charger 412 located on the outer side of the photosensitive belt 401.

The recording paper after transfer is conveyed by a transport belt 417 to reach a pair of fixing rollers 417. One of the fixing rollers 417 is heated by a heater (not shown). The toner of each color is then fixed to the recording paper by thermal fusion resulting from heating and pressing. The recording paper having the toner images fixed thereto is delivered to the outside of the apparatus. Unnecessary matters such as toners adhering to the surface of the photosensitive belt 401 is scraped off by a cleaning blade 420 and are recovered.

Since a full-color image is formed by superposing the toner images formed by the plurality of image forming units 400Y to 400K on each other on the photosensitive belt 401, some color position discrepancy takes place in the full-color image formed on the photosensitive belt 401, also in the case of the fourth embodiment, when the speed of the photosensitive belt 401 is caused to vary by changes taking place in thickness of the photosensitive belt 401 and in diameter of the driving roller 404, as a result of their wear.

To solve this problem, according to the fourth embodiment, too, a mark is formed on the photosensitive belt 401, and the passing intervals of the mark are measured by detecting the mark at a predetermined point of time. Then, a correction process is carried out according to the measured value of the mark passing interval in a manner similar to the correction processes of the first to third embodiments described in the foregoing. The color position discrepancy can be suppressed to a level not exceeding a predetermined value by the correction process like in the cases of the first to third embodiments.

In each of the embodiments described above, the transport sped of the belt member at the time of measuring a one-revolving-round period of the belt member is equal to the image forming speed. However, the transport speed of the belt member at the time of measuring the one-round period may be arranged to differ from the image forming speed.

For example, the relative detection accuracy of the measured time value can be enhanced by arranging the transport speed of the belt member at the time of measuring the one-round period of the belt member to be smaller than the image forming speed. This modification is preferable because an error resulting from a lower travel speed of the belt member can be lessened, as the period of time required for one revolving round of the belt member is detected by a predetermined time resolution.

Further, some of image forming apparatuses are arranged to use one of a plurality of image forming speeds according to the kind of the recording material on which images are to be formed. This is because, as is well known, apposite fixing conditions for fixing toners to the recording material vary according to whether the recording material is a relatively thin paper (a normal mode), or a relatively thick paper (a thick paper mode), or a transparent resin sheet such as a sheet for OHP (an OHP mode), due to the difference in heat capacity among these different recording materials. This arrangement applies to a case where the fixing speed for one material is gradually made slower than others in the order mentioned above. In other words, with the fixing speed for the relatively thin paper assumed to be "1", the fixing speed for the relatively thick paper is preferably arranged to be "⅓", and the fixing speed for the transparent resin sheet to be "¼". In this instance, images are formed by making the image forming speed (the transport speed of the belt member, the rotating speed of the photosensitive drum or the like) about the same as these fixing speeds.

With an image forming apparatus having such a plurality of image forming speeds (fixing speeds), it is preferable to measure the one-revolving-round period of the belt member by setting the transport speed of the belt member at a speed other than the speed of the normal mode, i.e., at the speed of the thick paper mode or that of the OHP mode. Among the speeds of these three different modes, the speed of the OHP mode is of course most apposite. This arrangement obviates the necessity of setting a transport speed of the belt member for measuring a one-revolving-round period of the belt member and thus permits a reduction in the amount of information to be stored in a ROM which is employed as storage means.

In each of the embodiments described above, the time required for one revolving round of the belt member is measured. However, the invention is not limited to this arrangement. For example, two marks, instead of one mark, may be provided on the belt member. The passing of these marks is detected by some detecting means. Then, the exposure timing and the rotating speed of the driving roller are controlled and corrected in the manner described above by comparing the detected value of passing time thus obtained with a target value of time. This arrangement of modification permits a reduction in a length of time required for a sequence of processes for detecting the moving time of the belt member. While each of the embodiments described above is arranged to have the mark and the passing detecting (sensing) means only at one end of the belt member, this modification is arranged, for example, as follows. The two marks are disposed respectively on front and rear sides of the belt member (on both end sides in the direction perpendicular to the transport direction of the belt member) to have their phases (positions) deviating from each other. Then, a period of time elapsing from detection of the front mark by the passing detecting means until detection of the rear mark by the passing detecting means is measured.

In the case of each of the embodiments described above, the one-revolving-round period of the belt member is measured by detecting the mark provided beforehand on the belt member. This arrangement may be changed, according to the invention, to have a toner image formed on the belt member for detection, and to detect the toner image by a detecting means. For example, such a construction may be adopted that two toner images for detection are formed on the belt member and the passing time of the belt member is measured by a single sensor. In the case of that construction, two toner images for detection are formed on the belt member at a predetermined time interval, and a period of time after the sensor starts detecting one of the two toner images for detection until the sensor finishes detecting the other of the two toner images for detection is beforehand stored in a storage means as a target period of time. Then, during the correction control, the passing time of the belt member as measured is compared with the target period of time. However, in respect of the correction control, the arrangement for having the mark provided on the belt member beforehand is more advantageous than the arrangement for forming the toner image on the belt member. The reason for this lies in that the toner image for detection tends to be prevented from being adequately formed by splashing of the toner. In such a case, the accuracy of detection by the detecting means would be lowered.

What is claimed is:

1. An image forming apparatus comprising:

a belt member;

a driving roller arranged to support an inner surface of said belt member and to rotate at a predetermined constant rotating speed;

a plurality of image forming means arranged to respectively form a plurality of color images on said belt member or on a recording material born by said belt member in such a way as to have the plurality of color images superposed on top of one another;

measuring means for measuring a length of time required for said belt member to move a predetermined distance when said driving roller is rotated at said predetermined constant rotating speed; and control means for controlling, on the basis of the length of time measured by said measuring means, a timing of start of forming each of the plurality of color images by each of said plurality of image forming means on said belt member or on the recording material born by said belt member.

2. An image forming apparatus according to claim 1, wherein said image forming apparatus further comprises storage means which stores data of a target time required for said belt member to move the predetermined distance, and said control means controls, on the basis of a difference between the target time stored in said storage means and the length of time measured by said measuring means, the timing of start of forming each of the plurality of color images by each of said plurality of image forming means on said belt member or on the recording material borne by said belt member.

3. An image forming apparatus according to claim 1, wherein said measuring means measures a plurality of times the length of time required for said belt member to move the predetermined distance, and said control means controls, on the basis of an average of a plurality of lengths of time measured by said measuring means, the timing of start of forming each of the plurality of color images by each of said plurality of image forming means on said belt member or on the recording material borne by said belt member.

4. An image forming apparatus according to claim 1, wherein said measuring means is provided with a sensor for detecting a mark provided on said belt member, and measures a length of time after said sensor detects the mark on said belt member until said sensor next detects the mark on said belt member.

5. An image forming apparatus according to claim 1, wherein said measuring means is provided with a sensor for detecting a plurality of marks provided on said belt member, including first and second marks, and measures a length of time after said sensor detects the first mark on said belt member until said sensor detects the second mark on said belt member.

6. An image forming apparatus according to claim 1, wherein said measuring means is provided with a sensor for detecting an image for detection formed on said belt member by said plurality of image forming means, and measures a length of time after said sensor detects the image for detection on said belt member until said sensor next detects the image for detection on said belt member.

7. An image forming apparatus according to claim 1, wherein said measuring means is provided with a sensor for detecting a plurality of images for detection formed on said belt member by said plurality of image forming means, including first and second images for detection, and measures a length of time after said sensor detects the first image for detection on said belt member until said sensor detects the second image for detection on said belt member.

8. An image forming apparatus according to any one of claims 1 to 7, wherein, when said measuring means is measuring a length of time required for said belt member to move the predetermined distance, a moving speed of said belt member is changed over to a speed lower than a moving speed of said belt member at which the plurality of color images are respectively formed by said plurality of image forming means on said belt member or on the recording material borne by said belt member.

9. An image forming apparatus according to any of claims 1 to 7, wherein said image forming apparatus has a first mode in which, when a moving speed of said belt member is a first moving speed, the plurality of color images are formed by said image forming means on said belt member or on the recording material borne by said belt member in a state of being superposed on top of one another, and a second mode in which, when the moving speed of said belt member is a second moving speed lower than the first moving speed, the plurality of color images are formed by said image forming means on said belt member or on the recording material borne by said belt member in a state of being superposed on top of one another, and wherein, when said measuring means is measuring a length of time required for said belt member to move the predetermined distance, the moving speed of said belt member is changed over to the second moving speed.

10. An image forming apparatus according to claim 1, wherein said plurality of image forming means are provided respectively with image bearing members for bearing images, and a plurality of color images on said image bearing members are serially formed, in a state of being superposed on top of one another, on the recording material borne by said belt member.

11. An image forming apparatus according to claim 1, wherein said image forming means are provided respectively with image bearing members for bearing images, a plurality of color images on said image bearing members are serially formed, in a state of being superposed on top of one another, on said belt member, and the plurality of color images on said belt member are transferred to the recording material.

12. An image forming apparatus according to claim 10 or 11, wherein said control means controls, on the basis of the length of time measured by said measuring means, the timing of start of forming each of the plurality of color images on each of said image bearing members.

13. An image forming apparatus according to claim 1, wherein said belt member is a photosensitive member, said plurality of image forming means serially form the plurality of color images on said photosensitive member in such a way as to have the plurality of color images superposed on top of one another, and the plurality of color images on said photosensitive member are transferred to the recording material.

14. An image forming apparatus according to claim 13, wherein said control means controls, on the basis of the length of time measured by said measuring means, the timing of start of forming each of the plurality of color images on said photosensitive member.

15. An image forming apparatus according to claim 1, wherein said image forming apparatus further comprises cleaning means for cleaning said belt member by coming into contact with said belt member.

16. An image forming apparatus according to claim 15, wherein said cleaning means is provided with a blade.

17. An image forming apparatus according to claim 1, wherein said driving roller is provided with rubber on a surface thereof at which to support said belt member.

18. An image forming apparatus according to claim 1, wherein said image forming apparatus further comprises driving means for imparting a driving force to said driving roller.

19. An image forming apparatus according to claim 18, wherein said driving means is provided with a pulse motor.

20. An image forming apparatus comprising:

a belt member;

a driving roller arranged to support an inner surface of said belt member and to rotate constantly at a predetermined constant rotating speed;

a plurality of image forming means arranged to respectively form a plurality of color images on said belt member or on a recording material borne by said belt member in such a way as to have the plurality of color images superposed on top of one another;

measuring means for measuring a length of time required for said belt member to move a predetermined distance when said driving roller is rotating at said predetermined constant rotating speed; and control means for changing, on the basis of the length of time measured by said measuring means, said predetermined constant rotating speed of said driving roller.

21. An image forming apparatus according to claim 20, wherein said image forming apparatus further comprises storage means which stores data of a target time required for said belt member to move the predetermined distance, and said control means controls the rotating speed of said driving roller in such a way as to cause the length of time measured by said measuring means to become equal to the target time stored in said storage means.

22. An image forming apparatus according to claim 20, wherein said measuring means measures a plurality of times the length of time required for said belt member to move the predetermined distance, and said control means controls, on the basis of an average of a plurality of lengths of time measured by said measuring means, the rotating speed of said driving roller.

23. An image forming apparatus according to claim 20, wherein said measuring means is provided with a sensor for detecting a mark provided on said belt member, and measures a length of time after said sensor detects the mark on said belt member until said sensor next detects the mark on said belt member.

24. An image forming apparatus according to claim 20, wherein said measuring means is provided with a sensor for detecting a plurality of marks provided on said belt member, including first and second marks, and measures a length of time after said sensor detects the first mark on said belt member until said sensor detects the second mark on said belt member.

25. An image forming apparatus according to claim 20, wherein said measuring means is provided with a sensor for detecting an image for detection formed on said belt member by said plurality of image forming means, and measures a length of time after said sensor detects the image for detection on said belt member until said sensor next detects the image for detection on said belt member.

26. An image forming apparatus according to claim 20, wherein said measuring means is provided with a sensor for detecting a plurality of images for detection formed on said belt member by said plurality of image forming means, including first and second images for detection, and measures a length of time after said sensor detects the first image for detection on said belt member until said sensor detects the second image for detection on said belt member.

27. An image forming apparatus according to any of claims 20 to 26, wherein, when said measuring means is measuring a length of time required for said belt member to move the predetermined distance, a moving speed of said belt member is changed over to a speed lower than a moving speed of said belt member at which the plurality of color images are respectively formed by said plurality of image forming means on said belt member or on the recording material borne by said belt member.

28. An image forming apparatus according to any of claims 20 to 26, wherein said image forming apparatus has a first mode in which, when a moving speed of said belt member is a first moving speed, the plurality of color images are formed by said image forming means on said belt member or on the recording material borne by said belt member in a state of being superposed on top of one another, and a second mode in which, when the moving speed of said belt member is a second moving speed lower than the first moving speed, the plurality of color images are formed by said image forming means on said belt member or on the recording material borne by said belt member in a state of being superposed on top of one another, and wherein, when said measuring means is measuring a length of time required for said belt member to move the predetermined distance, the moving speed of said belt member is changed over to the second moving speed.

29. An image forming apparatus according to any of claims 20 to 26, wherein said image forming apparatus further comprises driving means for imparting a driving force to said driving roller, and said control means controls, on the basis of the length of time measured by said measuring means, the driving force to be imparted to said driving roller by said driving means.

30. An image forming apparatus according to claim 29, wherein said driving means is provided with a pulse motor.

31. An image forming apparatus according to claim 20, wherein said plurality of image forming means are provided respectively with image bearing members for bearing images, and a plurality of color images on said image bearing members are serially formed, in a state of being superposed on top of one another, on the recording material borne by said belt member.

32. An image forming apparatus according to claim 20, wherein said image forming means are provided respectively with image bearing members for bearing images, a plurality of color images on said image bearing members are serially formed, in a state of being superposed on top of one another, on said belt member, and the plurality of color images on said belt member are transferred to the recording material.

33. An image forming apparatus according to claim 31 or 32, wherein said control means controls, on the basis of the length of time measured by said measuring means, the timing of start of forming each of the plurality of color images on each of said image bearing members.

34. An image forming apparatus according to claim 20, wherein said belt member is a photosensitive member, said plurality of image forming means serially form the plurality of color images on said photosensitive member in such a way as to have the plurality of color images superposed on top of one another, and the plurality of color images on said photosensitive member are transferred to the recording material.

35. An image forming apparatus according to claim 34, wherein said control means controls, on the basis of the length of time measured by said measuring means, the timing of start of forming each of the plurality of color images on said photosensitive member.

36. An image forming apparatus according to claim 20, wherein said image forming apparatus further comprises cleaning means for cleaning said belt member by coming into contact with said belt member.

37. An image forming apparatus according to claim 36, wherein said cleaning means is provided with a blade.

38. An apparatus according to claim 20, wherein said driving roller is provided with rubber on a surface thereof at which to support said belt member.

39. An image forming apparatus comprising:

a belt member;

a driving roller arranged to support said belt member and to transmit a driving force to said belt member;

a plurality of image forming means arranged to respectively form a plurality of color images on said belt member or on a recording material borne by said belt member in such a way as to have the plurality of color images superposed on top of one another;

measuring means for measuring a length of time required for said belt member to move a predetermined distance; and control means for controlling, on the basis of the length of time measured by said measuring means, the timing of start of forming each of the plurality of color images by each of said plurality of image forming means on said belt member or on the recording material borne by said belt member, wherein said measuring means measures a plurality of times the length of time required for said belt member to move the predetermined distance, and said control means controls on the basis of an average of a plurality of lengths of time measured by said measuring means, the timing of start of forming each of the plurality of color images by each of said plurality of image forming means on said belt member or on the recording material borne by said belt member.

40. An image forming apparatus comprising:

a belt member;

a driving roller arranged to support said belt member and to transmit a driving force to said belt member;

a plurality of image forming means arranged to respectively form a plurality of color images on said belt member or on a recording material borne by said belt member in such a way as to have the plurality of color images superposed on top of one another;

measuring means for measuring a length of time required for said belt member to move a predetermined distance; and control means for controlling, on the basis of the length of time measured by said measuring means, the timing of start of forming each of the plurality of color images by each of said plurality of image forming means on said belt member or on the recording material borne by said belt member, wherein, when said measuring means is measuring a length of time required for said belt member to move the predetermined distance, a moving speed of said belt member is changed over to a speed lower than a moving speed of said belt member at which the plurality of color images are respectively formed by said plurality of image forming means on said belt member or on the recording material borne by said belt member.

41. An image forming apparatus comprising:

a belt member;

a driving roller arranged to support said belt member and to transmit a driving force to said belt member;

a plurality of image forming means arranged to respectively form a plurality of color images on said belt member or on a recording material borne by said belt member in such a way as to have the plurality of color images superposed on top of one another;

measuring means for measuring a length of time required for said belt member to move a predetermined distance; and control means for controlling, on the basis of the length of time measured by said measuring means, the timing of start of forming each of the plurality of color images by each of said plurality of image forming means on said belt member or on the recording material borne by said belt member, wherein said image forming apparatus has a first mode in which, when a moving speed of said belt member is a first moving speed, the plurality of color images are formed by said image forming means on said belt member or on the recording material borne by said belt member in a state of being superposed on top of one another, and a second mode in which, when the moving speed of said belt member is a second moving speed lower than the first moving speed, the plurality of color images are formed by said image forming means on said belt member or on the recording material borne by said belt member in a state of being superposed on top of one another, and wherein, when said measuring means is measuring a length of time required for said belt member to move the predetermined distance, the moving speed of said belt member is changed over to the second moving speed.

42. An image forming apparatus comprising:

a belt member;

a driving roller arranged to support said belt member and to transmit a driving force to said belt member;

a plurality of image forming means arranged to respectively form a plurality of color images on said belt member or on a recording material borne by said belt member in such a way as to have the plurality of color images superposed on top of one another;

measuring means for measuring a length of time required for said belt member to move a predetermined distance; and control means for controlling, on the basis of the length of time measured by said measuring means, a rotating speed of said driving roller, wherein said measuring means measures a plurality of times the length of time required for said belt member to move the predetermined distance, and said control means controls, on the basis of an average of a plurality of lengths of time measured by said measuring means, the rotating speed of said driving roller.

43. An image forming apparatus comprising:

a belt member;

a driving roller arranged to support said belt member and to transmit a driving force to said belt member;

a plurality of image forming means arranged to respectively form a plurality of color images on said belt member or on a recording material borne by said belt member in such a way as to have the plurality of color images superposed on top of one another;

measuring means for measuring a length of time required for said belt member to move a predetermined distance; and control means for controlling, on the basis of the length of time measured by said measuring means, a rotating speed of said driving roller, wherein, when said measuring means is measuring a length of time required for said belt member to move the predetermined distance, a moving speed of said belt member is changed over to a speed lower than a moving speed of said belt member at which the plurality of color images are respectively formed by said plurality of image forming means on said belt member or on the recording material borne by said belt member.

44. An image forming apparatus comprising:

a belt member;

a driving roller arranged to support said belt member and to transmit a driving force to said belt member;

a plurality of image forming means arranged to respectively form a plurality of color images on said belt member or on a recording material borne by said belt member in such a way as to have the plurality of color images superposed on top of one another;

measuring means for measuring a length of time required for said belt member to move a predetermined distance; and control means for controlling, on the basis of the length of time measured by said measuring means, a rotating speed of said driving roller, wherein said image forming apparatus has a first mode in which, when a moving speed of said belt member is a first moving speed, the plurality of color images are formed by said image forming means on said belt member or on the recording material borne by said belt member in a state of being superposed on top of one another, and a second mode in which, when the moving speed of said belt member is a second moving speed lower than the first moving speed, the plurality of color images are formed by said image forming means on said belt member or on the recording material borne by said belt member in a state of being superposed on top of one another, and wherein, when said measuring means is measuring a length of time required for said belt member to move the predetermined distance, the moving speed of said belt member is changed over to the second moving speed.

* * * * *

UNITED STATES PATENT AND TRADEMARK OFFICE

CERTIFICATE OF CORRECTION

PATENT NO. : 6,493,533 B1
DATED : December 10, 2002
INVENTOR(S) : Munakata

It is certified that error appears in the above-identified patent and that said Letters Patent is hereby corrected as shown below:

Drawings,
Sheet 4, Figure 4, Step S4, “PASSGE” should read -- PASSAGE --.

Column 1,
Line 52, “a” should read -- at --.

Column 2,
Line 36, “sped” should read -- speed --.

Column 5,
Line 29, “sped” should read -- speed --.

Column 12,
Line 19, “sped” should read -- speed --.

Column 13,
Line 54 and 66, “born” should read -- borne --.

Signed and Sealed this

Fourth Day of November, 2003

JAMES E. ROGAN
*Director of the United States Patent and Trademark Office*